US005154047A

United States Patent [19]

Takagi

[11] Patent Number: 5,154,047

[45] Date of Patent: Oct. 13, 1992

[54] WATCH BAND

[75] Inventor: Akiyoshi Takagi, Tanashi, Japan

[73] Assignee: Citizen Watch Co., Ltd., Tokyo, Japan

[21] Appl. No.: 644,224

[22] Filed: Jan. 22, 1991

[30] Foreign Application Priority Data

Jan. 31, 1990 [JP] Japan ..... 2-18815

[51] Int. Cl.[5] ..... F16G 13/00

[52] U.S. Cl. ..... 59/80; 59/78; 59/82; 63/3

[58] Field of Search ..... 59/78, 79.1, 79.3, 80, 59/82; 63/3, 4

[56] References Cited

U.S. PATENT DOCUMENTS 1,598,250 8/1926 Person ..... 59/80
1,847,901 3/1932 Roy ..... 59/80
2,263,338 11/1941 Kestenman ..... 59/80
4,840,044 6/1989 Scholpp ..... 59/80
4,930,304 6/1990 Meister ..... 59/80

FOREIGN PATENT DOCUMENTS 0656695 10/1963 Italy ..... 59/80
0431168 8/1967 Switzerland ..... 59/80

*Primary Examiner*—David Jones
*Attorney, Agent, or Firm*—Birch, Stewart, Kolasch & Birch

[57] ABSTRACT

A watch band has a plurality of link units connected with each other by connecting pins. Each of the link units comprises a link and a connecting member in the form of a projection. The connecting member is engaged with a recess formed on one side of an adjacent link and connected thereto. An ornamental plate having a different color from the link is mounted on the connecting member.

3 Claims, 28 Drawing Sheets

WATCH BAND

BACKGROUND OF THE INVENTION

The present invention relates to a watch band.

A conventional watch band comprises a plurality of links connected with each other. Each link has a recess on one side in the longitudinal direction of the band to be engaged with a connecting projection formed on the adjacent link opposite to the recess, and the links are connected through a pin.

However, since all links of the conventional watch band are made of solid metal, the link has a simple decorative form. Hence, it is difficult to provide various designs for the band.

SUMMARY OF THE INVENTION

The object of the present invention is to provide a watch band which may have a variety of designs, thereby enhancing decorative effect of the band.

According to the present invention, there is provided a watch band having a plurality of link units connected with each other by connecting pins, wherein each of the link units comprises a link and a connecting member. Each link has a recess formed on one side and a pair of legs defining the recess and projecting in a longitudinal direction of the band. An ornamental plate having a different color from the link is mounted on the connecting member, and the connecting member is engaged with the recess of an adjacent link and connected with the legs by the connecting pin.

In an aspect of the invention, the connecting member has an upper engaging notch and a lower engaging notch, and the ornamental plate has engaging edges which are engaged with the upper and lower engaging notches, respectively. The connecting member is in the form of a projection projecting from the side of the link opposite the recess.

In another aspect, the connecting member is a connecting link: the link has a pair of recesses at both sides thereof: and the connecting link is engaged with both recesses of adjacent links and connected thereto by pins, respectively.

These and other objects and features of the present invention will become more apparent from the following detailed description with reference to the accompanying drawings.

DETAILED DESCRIPTION OF THE PREFERRED EMBODIMENTS

Figure 1:
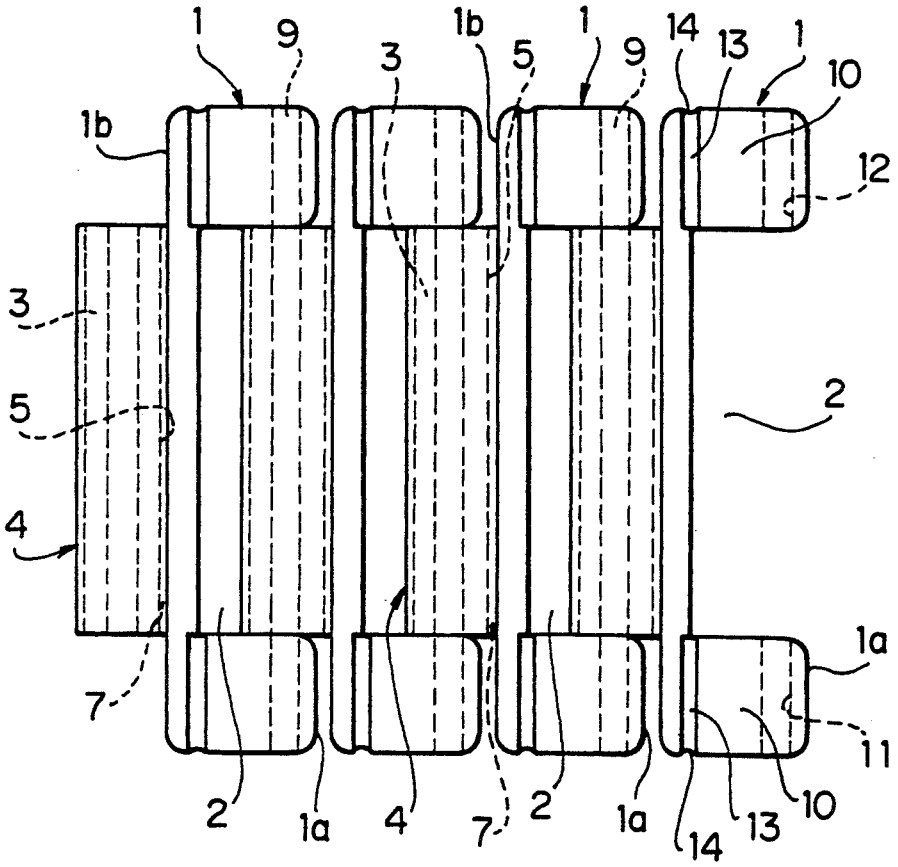
FIG. 1 is a plan view showing a part of a watch band according to the present invention.
Figure 2:
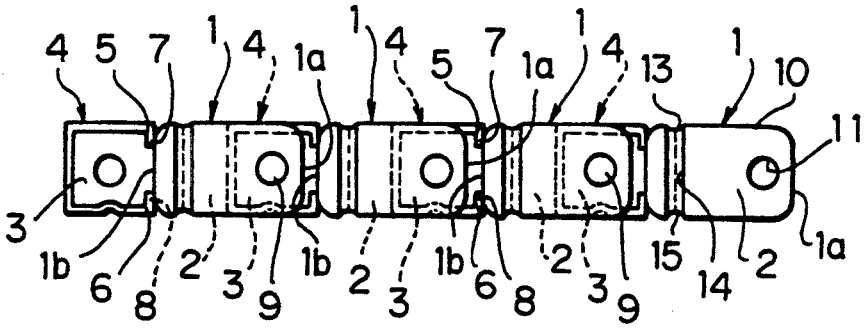
FIG. 2 is a side view of the watch band.
Figure 3:
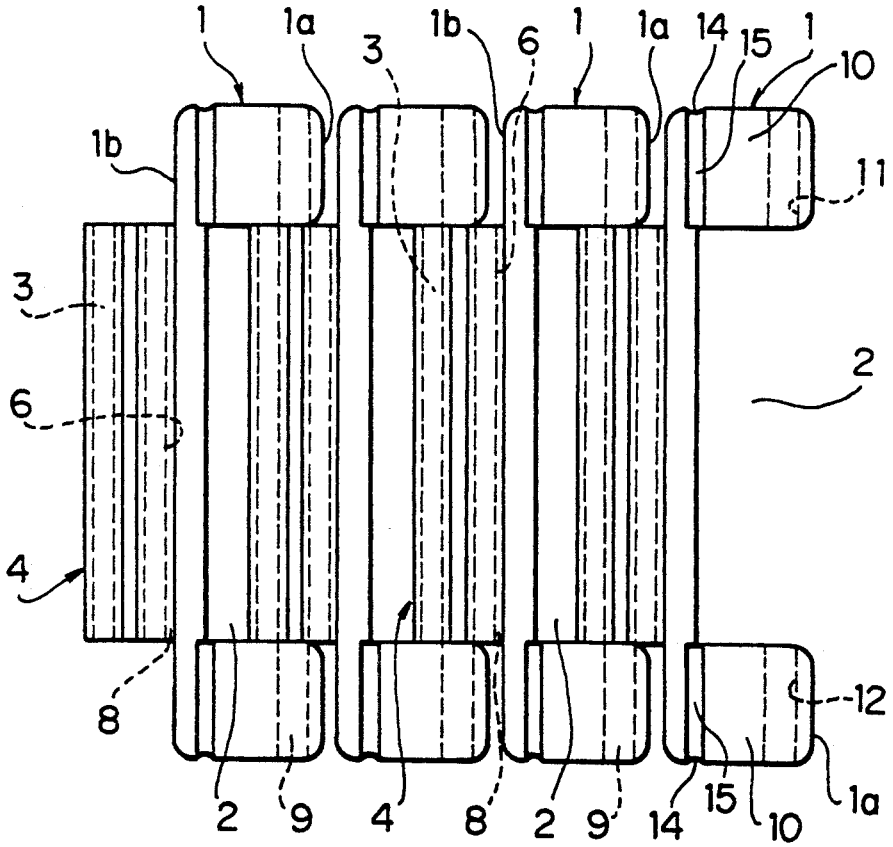
FIG. 3 is a plan view showing the reverse side of the watch band.

Referring to FIGS. 1 to 3, a watch band of the present invention comprises a plurality of link units. Each link unit comprises a link 1 made of brass and having a recess 2 formed on one side 1*a* in the longitudinal direction of the band. A pair of connecting legs 10, 10 are defined by the recess 2. A connecting member 3 is projected from the opposite side 1*b* of the link 1. An ornamental plate 4 is provided to be mounted on the connecting member 3. A connecting pin 9 is provided for connecting the adjacent links 1.

Figure 4:
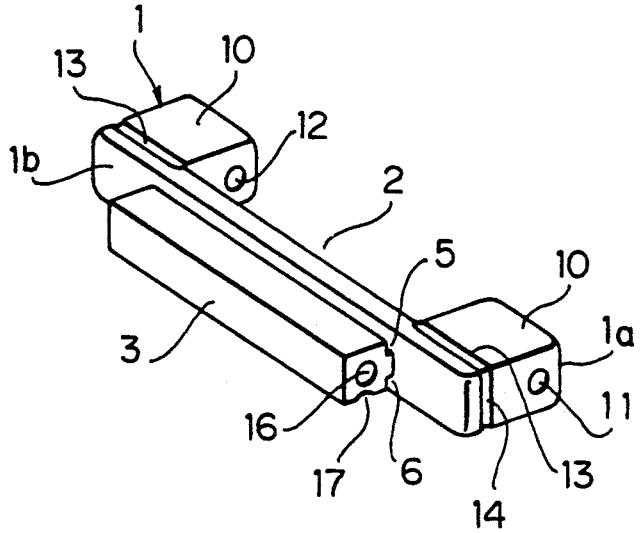
FIG. 4 is a perspective view showing a link of the band.
Figure 5:
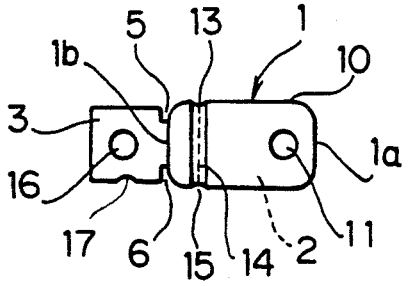
FIG. 5 is a side view of the link of FIG. 4.

Referring to FIGS. 4 and 5, one of the connecting legs 10 of the link 1 has a perforated hole 11 formed in the lateral direction of the band to be pivotally engaged with the connecting pin 9. The other connecting leg 10 has a perforated engaging hole 12 formed corresponding to the hole 11 to be fixedly engaged with the pin 9. Ornamental grooves 13, 14 and 15 are formed on the upper, side and reverse surfaces of the link 1 at a base portion of each connecting leg 10.

The connecting member 3 is in the form of a projection to be engaged with the recess 2 of the adjacent link 1, and has a vertical thickness slightly smaller than that of the link body. A perforated connecting hole 16 is formed in the connecting member 3, corresponding to holes 11 and 12, and a pair of upper and lower engaging lateral notches 5 and 6 are formed along the side 1*b*. Further, an engaging lateral groove 17 is formed on the reverse surface of the connecting member 3 at a central portion thereof.

Figure 6:
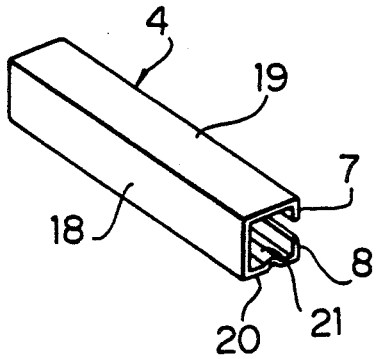
FIG. 6 is a perspective view showing a decorating plate.
Figure 7:
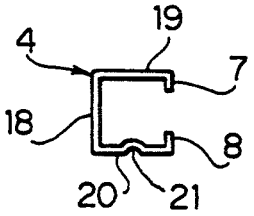
FIG. 7 is a side view of the decorating plate of FIG. 6.

Referring to FIGS. 6 and 7, the ornamental plate 4 is made of stainless steel alloy plate which is a different material from the link 1. The ornamental plate 4 has a vertical portion 18, an upper horizontal portion 19, a lower horizontal portion 20, which are formed by bending the metal plate. Thus, the ornamental plate 4 has a U-shape in cross-section. A downwardly bent engaging edge 7 is formed at a side of the upper portion 19 and an upwardly bent engaging edge 8 is formed at a side of the lower portion 20. On the lower portion 20, a lateral projection 21 is formed in a central portion thereof corresponding to the lateral groove 17 of the connecting member 3.

In order to attach the ornamental plate 4 to the connecting member 3, an opening end of the the ornamental plate 4 is engaged with an end of the connecting member 3 and the engaging edge 7 of the ornamental plate 4 is engaged with the engaging notch 5 of the connecting member 3, while the engaging edge 8 is engaged with the engaging notch 6. The lateral projection 21 of the lower portion 20 is engaged with the lateral groove 17 of the member 3. The ornamental plate 4 is laterally pushed so that the plate 4 is entirely mounted on the the connecting member 3.

The ornamental plate 4 is formed to have a thickness corresponding to the difference of the thicknesses between the link 1 and the connecting member 3. Consequently, when the ornamental plate 4 is mounted on the connecting member 3, the surface of the upper portion 19 of the plate 4 is flush with the upper surface of the link 1 and the surface of the lower portion 20 is flush with the reverse surface of the link 1.

Figure 8:
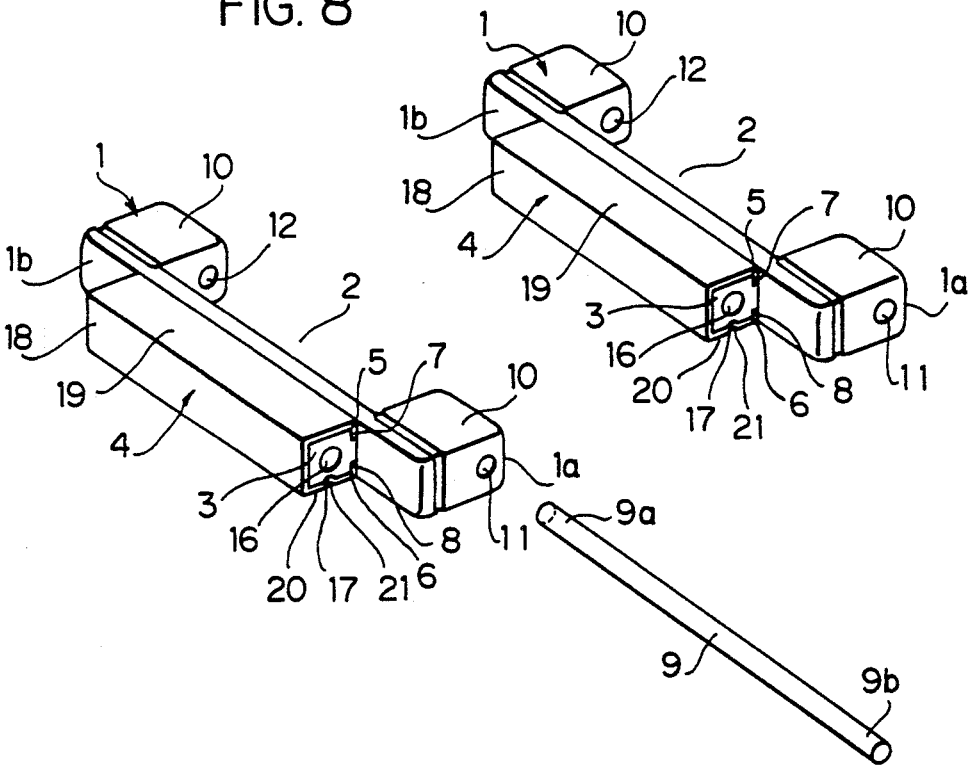
FIG. 8 is an exploded perspective view for explaining an assembling of links of the band.
Figure 9:
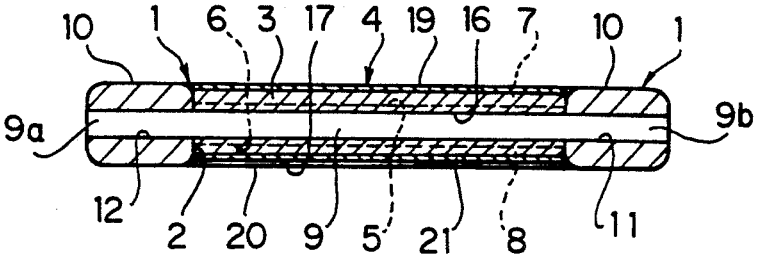
FIG. 9 is a sectional view showing a main part of the band.
Figure 10:
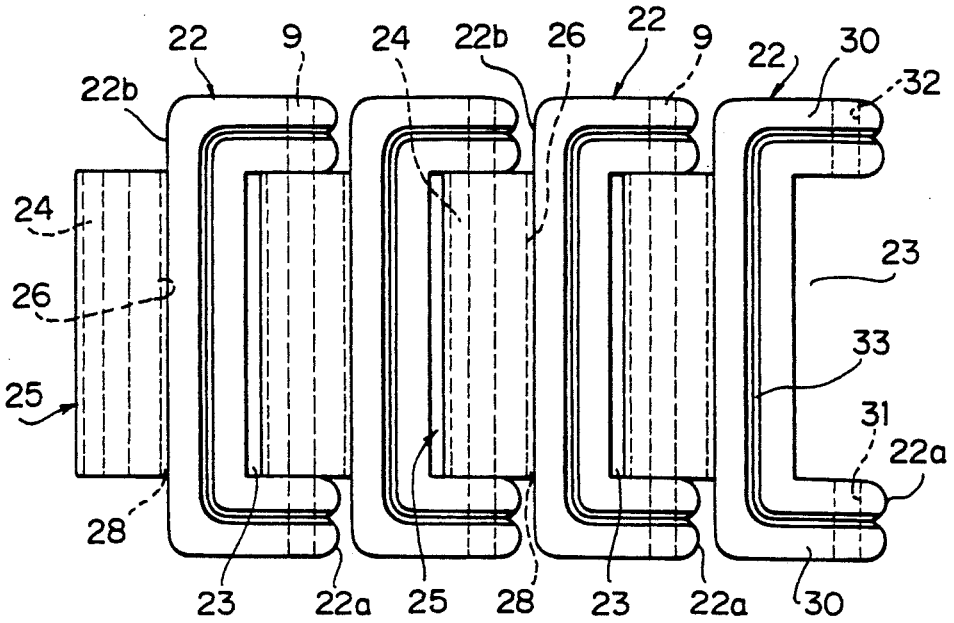
FIG. 10 is a plan view showing a part of a watch band of a second embodiment of the present invention.
Figure 11:
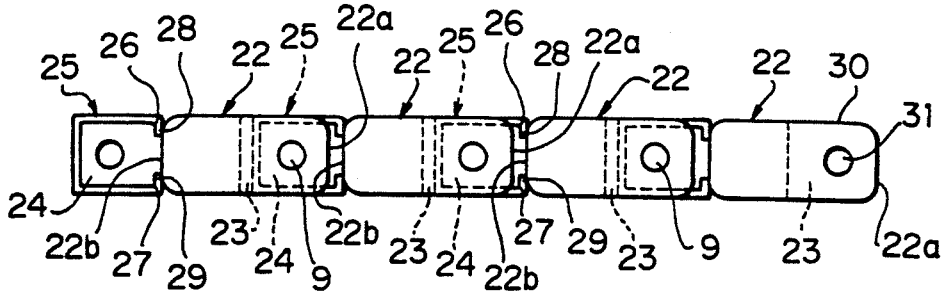
FIG. 11 is a side view of the second embodiment.

Operation for connecting the link 1 to the adjacent link 1 will be described with reference to FIGS. 8 and 9.

After engaging the ornamental plate 4 with the connecting member 3, the connecting member 3 of the adjacent link 1 is engaged with the recess 2 of the link 1. The perforated hole 16 of the connecting member 3 of the adjacent link 1 is aligned with the perforated holes 11 and 12 of the connecting legs 10 and 10 of the link 1. The connecting pin 9 is inserted in the perforated hole 11 of the link 1, hole 16 of the adjacent link and hole 12 of the link 1. An end 9*a* of the pin 9 is engaged with the hole 12 in force fit so that the pin 9 is secured to the leg 10 and another end 9*b* of the pin 9 engages with the hole 11. Thus, the link 1 is connected to the adjacent link 1 by the connecting pin 9.

Figure 12:
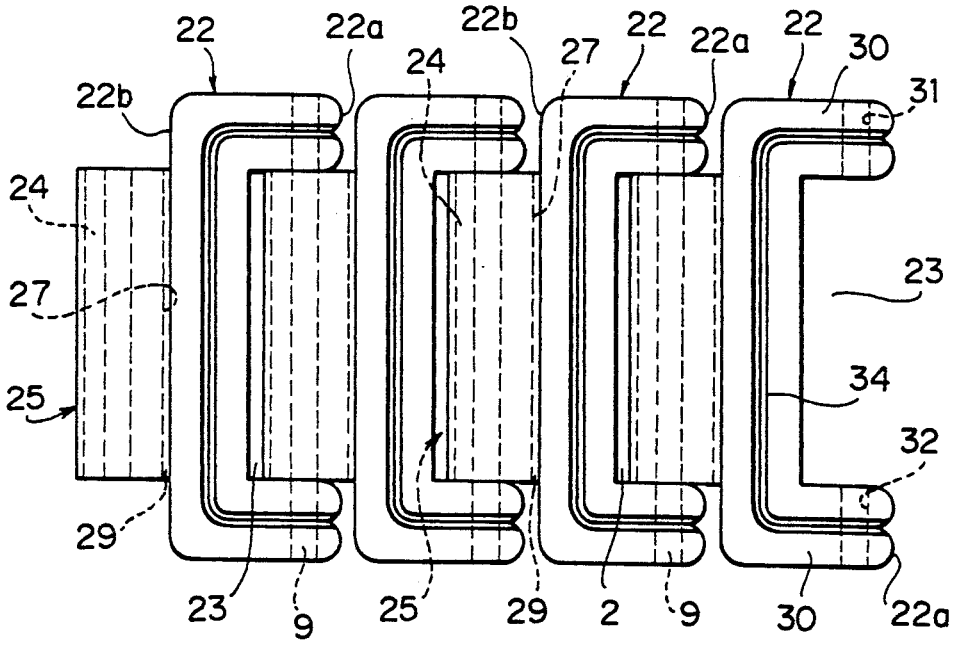
FIG. 12 is a plan view showing the reverse side of the second embodiment.
Figure 13:
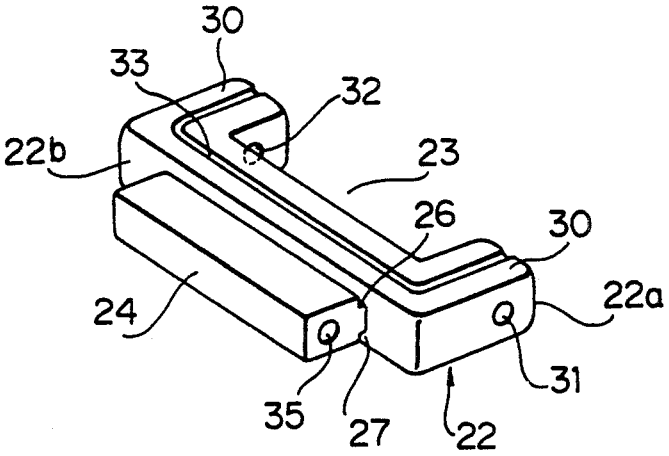
FIG. 13 is a perspective view showing a link of the second embodiment.
Figure 14:
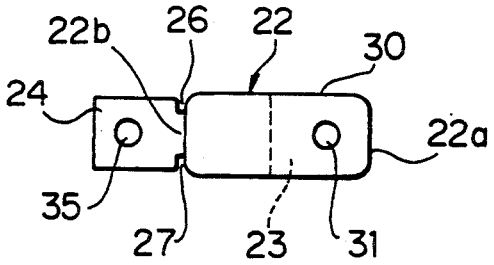
FIG. 14 is a side view of the link of FIG. 13.

Referring to FIGS. 10 to 17 showing the second embodiment of the present invention, a link 22 made of brass has a recess 23 on one side 22*a* of the link 22, defining a pair of connecting legs 30, 30, a connecting member 24 projects from the opposite side 22*b* of the link 22 opposite to the recess 23. An ornamental plate 25 made of stainless steel alloy to be mounted on the connecting member 24, and the connecting pin 9 is provided. A perforated hole 31 and a perforated engaging hole 32 are formed in the connecting legs 30, 30 respectively. An ornamental groove 33 is formed on the surface of the link 22 and a groove 34 is formed on the reverse surface of the link (FIG. 12).

The connecting member 24 is provided to be engaged with the recess 23 of the adjacent link 22. A perforated hole 35 and a pair of upper and lower engaging notches 26 and 27 are formed in the connecting member 24 in the same manner as the first embodiment. However, in the connecting member 24 of the second embodiment, the lateral groove 17 of the first embodiment is not formed on the reverse surface.

Figure 15:
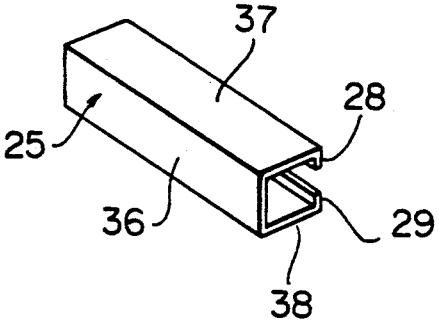
FIG. 15 is a perspective view showing a decorating plate of the second embodiment.
Figure 16:
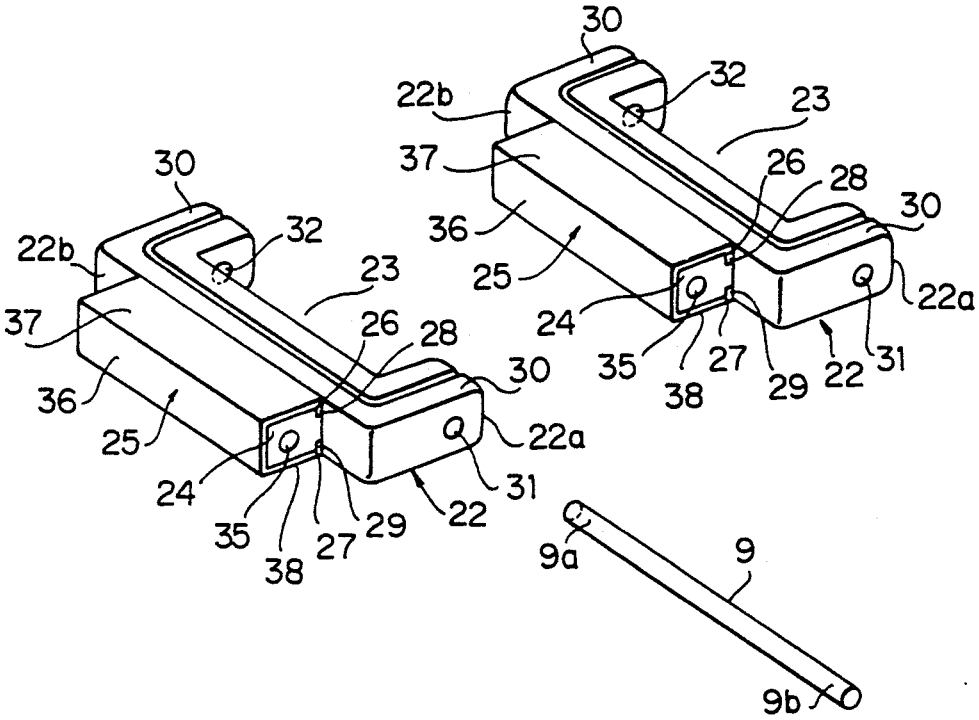
FIG. 16 is an exploded perspective view for explaining an assembling of links of the second embodiment.
Figure 17:
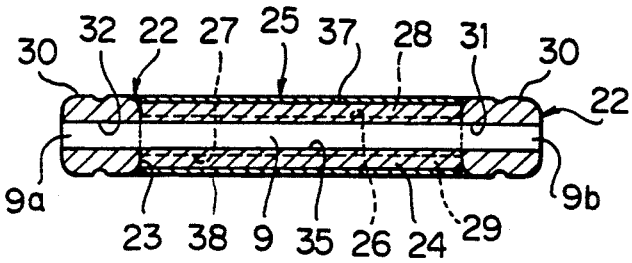
FIG. 17 is a sectional view showing a main part of the second embodiment.
Figure 18:
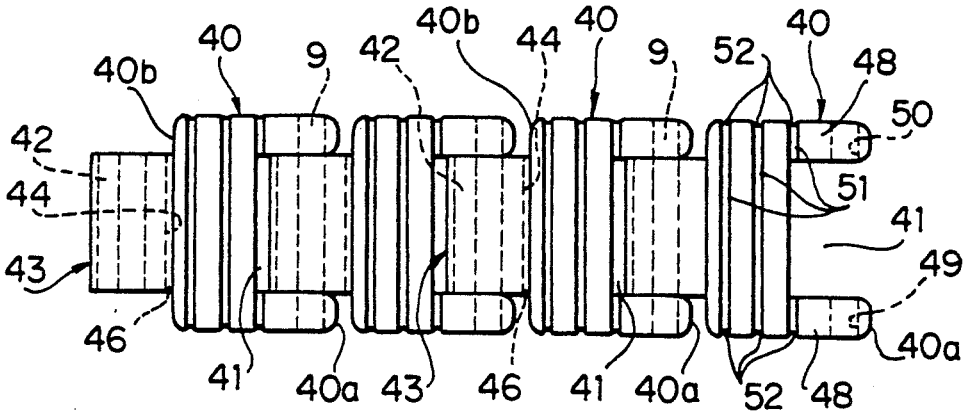
FIG. 18 is a plan view showing a third embodiment of the present invention.
Figure 19:
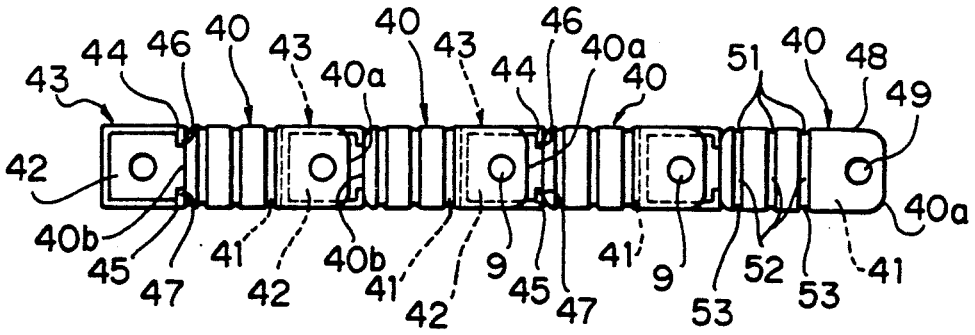
FIG. 19 is a side view of the third embodiment.
Figure 20:
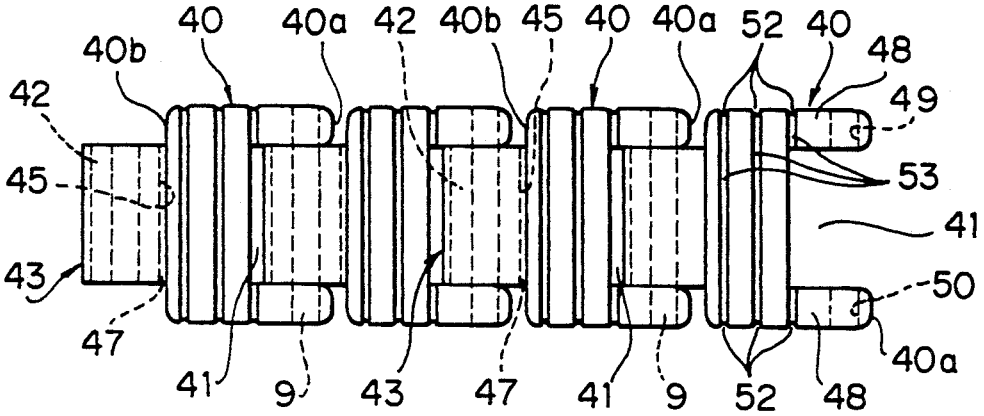
FIG. 20 is a plan view showing the reverse side of the third embodiment.
Figure 21:
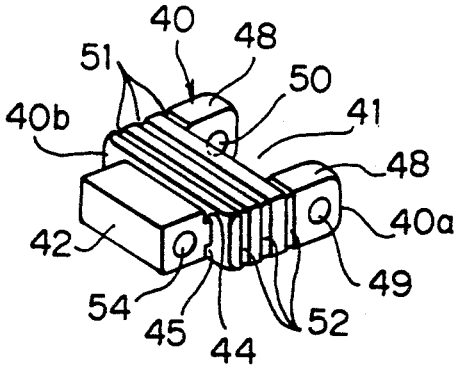
FIG. 21 is a perspective view showing a link of the third embodiment.
Figure 22:
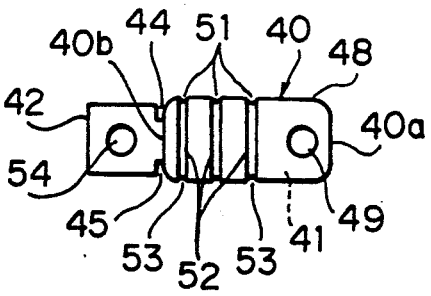
FIG. 22 is a side view of the link of FIG. 21.

As shown in FIG. 15, the ornamental plate 25 has a vertical portion 36, an upper horizontal portion 37 having an engaging edge 28 and a lower horizontal portion 38 having an engaging edge 29, which are the same as the ornamental plate 4 of the first embodiment. However, the projection 21 of the first embodiment is not formed on the lower portion 38.

In order to attach the ornamental plate 25 to the connecting member 24, the engaging edge 28 of the ornamental plate 25 is engaged with the engaging notch 26 of the connecting member 24, while the engaging edge 29 is engaged with the engaging notch 27. The ornamental plate 25 is laterally pushed to slide on the connecting member 24, so that the connecting member 24 is attached to the ornamental plate 25. When the ornamental plate 25 is mounted on the connecting member 24, the upper and lower surfaces of the ornamental plate 25 are flush with the upper and reverse surfaces of the link 22.

The method for connecting the link 22 to the adjacent link 22 is the same as the first embodiment. Hence, detailed description thereof is omitted.

Referring to FIGS. 18 to 25 showing the third embodiment, in which the lateral length of a link 40 in the embodiment is shorter than those of the previous embodiments to provide a band of a narrow width.

The link 40 made of brass has a recess 41 formed on one side 40*a* and defining a pair of connecting legs 48, 48. A connecting member 42 projects from the opposite side 40*b* opposite to the recess 41, an ornamental plate 43, and the connecting pin 9 are provided. A perforated hole 49 and a perforated engaging hole 50 are formed in the connecting legs 48, 48, respectively. A plurality of parallel grooves 51, 52 and 53 are formed on the upper, side and reverse surfaces of the link 40.

The connecting member 42 to be engaged with the recess 41 of the adjacent link 40 has a perforated hole 54 for the pin 9 and a pair of upper and lower engaging notches 44 and 45.

Figure 23:
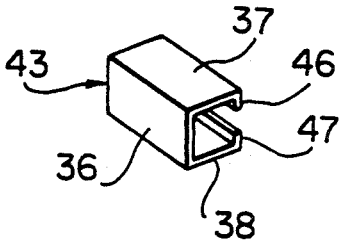
FIG. 23 is a perspective view showing a decorating plate of the third embodiment.
Figure 24:
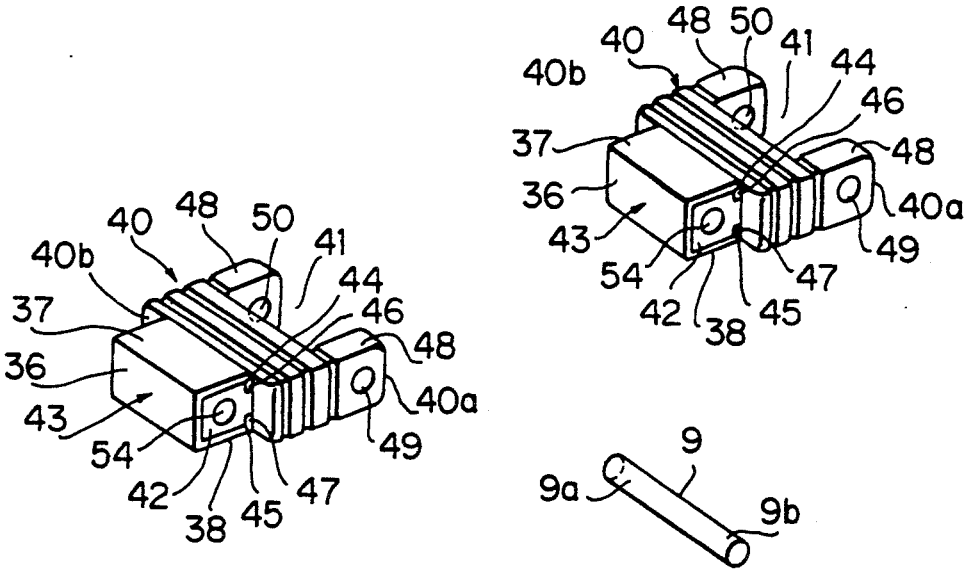
FIG. 24 is an exploded perspective view for explaining an assembling of links of the third embodiment.
Figure 25:
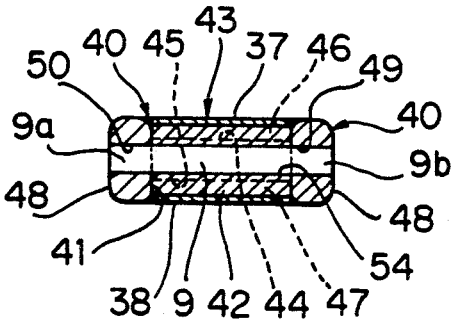
FIG. 25 is a sectional view showing a main part of the third embodiment.
Figure 26:
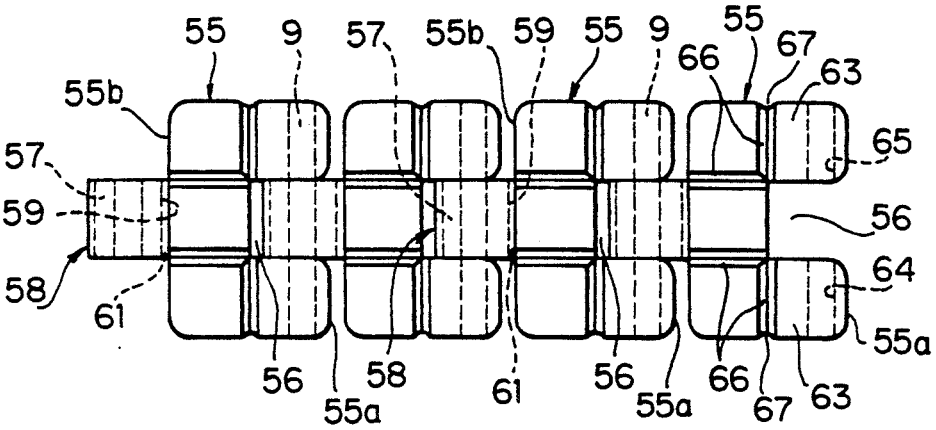
FIG. 26 is a plan view showing a fourth embodiment of the present invention.
Figure 27:
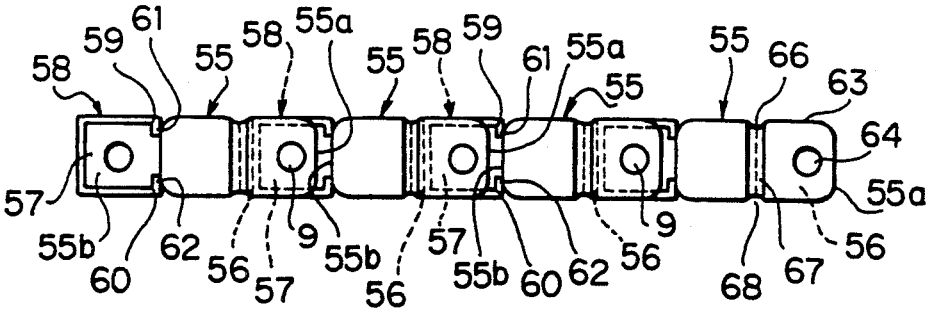
FIG. 27 is a side view of the fourth embodiment.
Figure 28:
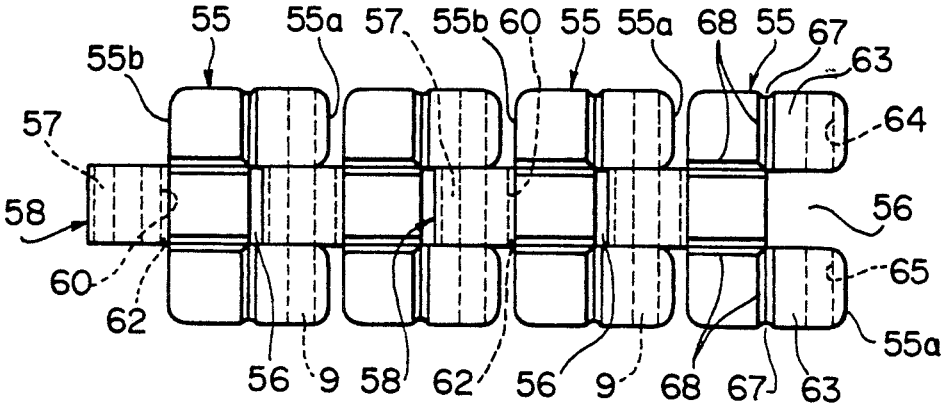
FIG. 28 is a plan view showing the reverse side of the fourth embodiment.
Figure 29:
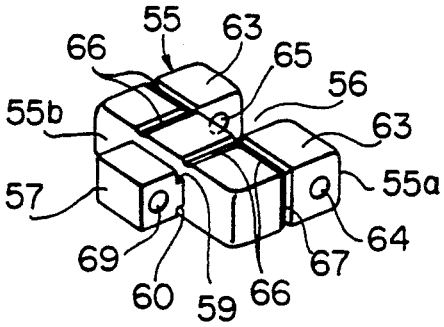
FIG. 29 is a perspective view showing a link of the fourth embodiment.
Figure 30:
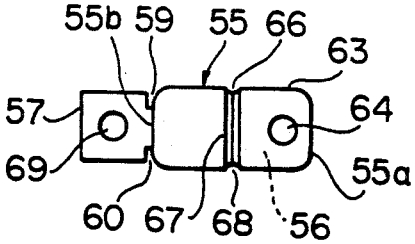
FIG. 30 is a side view of the link.

As shown in FIG. 23, the ornamental plate 43 has the same construction as the ornamental plate 25 of the second embodiment. Namely, the vertical portion 36, the upper horizontal portion 37 having an engaging edge 46, and the lower horizontal portion 38 having an engaging edge 47 are provided.

The method for attaching the ornamental plate 43 to the connecting member 42 and the method for connecting the link 40 to the adjacent link 40 are the same as the second embodiment.

When the ornamental plate 43 is mounted on the connecting member 42, the upper and lower surfaces of the ornamental plate 43 are flush with the upper and reverse surfaces of the link 40.

Referring to FIGS. 26 to 33 showing the fourth embodiment for a band of narrow width, a link 55 made of brass has one recess 56 formed on a side 55*a* and defining a pair of connecting legs 63, 63, a connecting member 57 projects from the opposite side 55*b* opposite to the recess 56: and an ornamental plate 58 is provided. A perforated hole 64 and a perforated engaging hole 65 are formed on the connecting legs 63, 63, respectively. The link 55 has a plurality of grooves 66 formed on the upper surface thereof, grooves 67 formed on both side surfaces thereof connected with the grooves 66, and grooves 68 formed on the reverse surface thereof.

The connecting member 57 to be engaged with the recess 56 of the adjacent link 55 has a perforated hole 69 for the pin 9 and a pair of upper and lower engaging notches 59 and 60.

Figure 31:
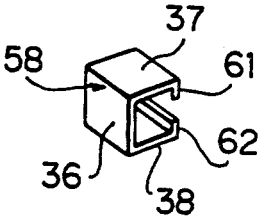
FIG. 31 is a perspective view showing a decorating plate of the fourth embodiment.
Figure 32:
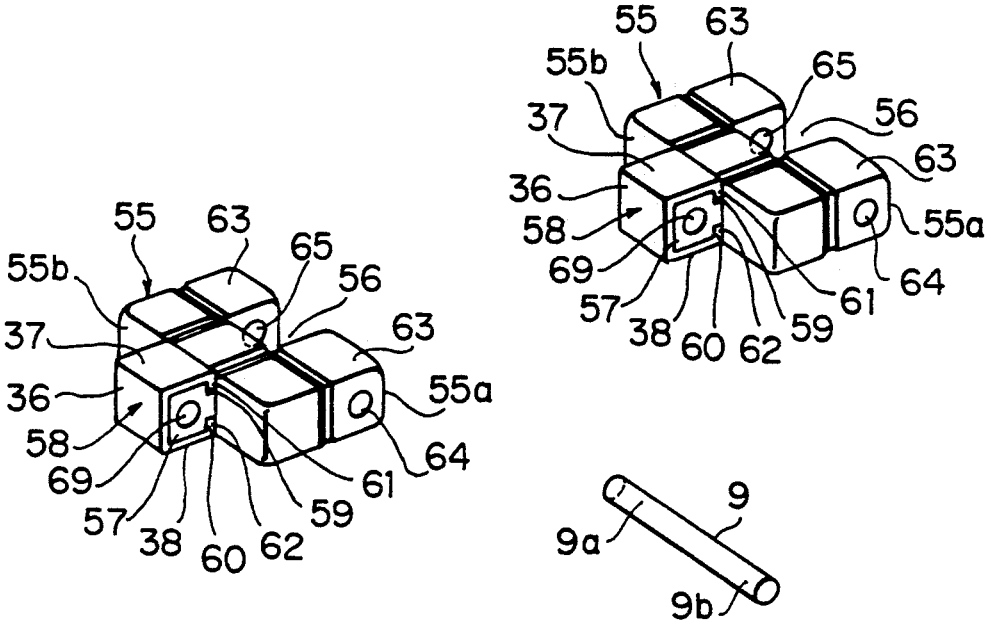
FIG. 32 is an exploded perspective view for explaining an assembling of links of the fourth embodiment.
Figure 33:
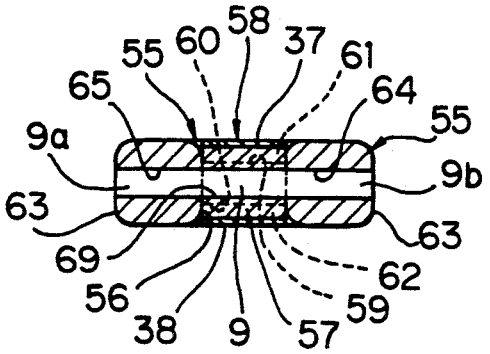
FIG. 33 is a sectional view showing a main part of the fourth embodiment.
Figure 34:
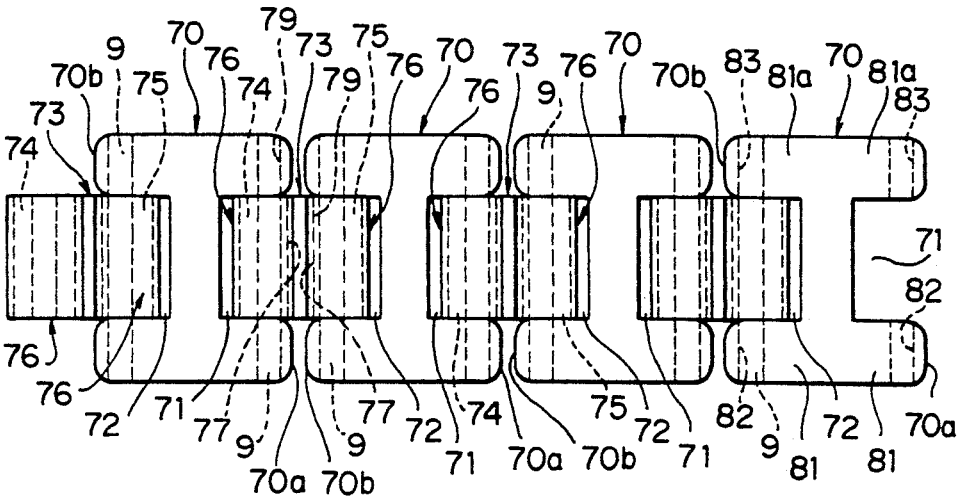
FIG. 34 is a plan view showing a fifth embodiment of the present invention.
Figure 35:
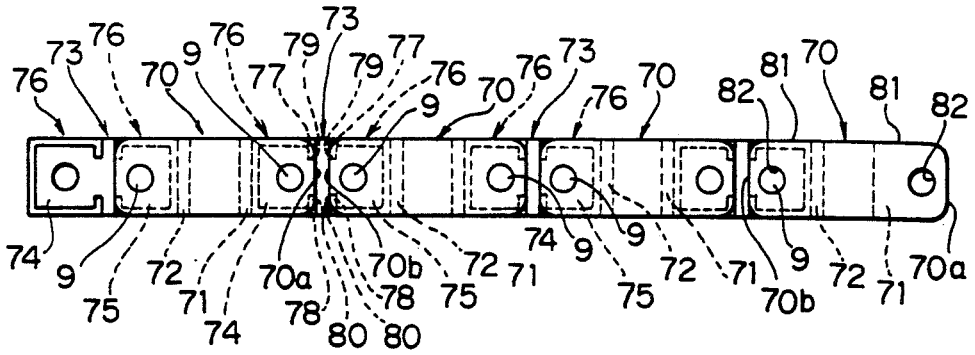
FIG. 35 is a side view of the fifth embodiment.
Figure 36:
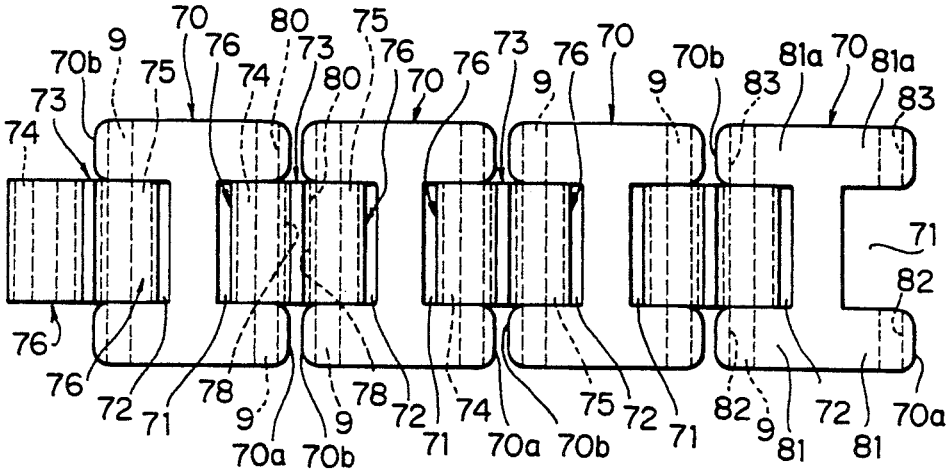
FIG. 36 is a plan view showing the reverse side of the fifth embodiment.
Figure 37:
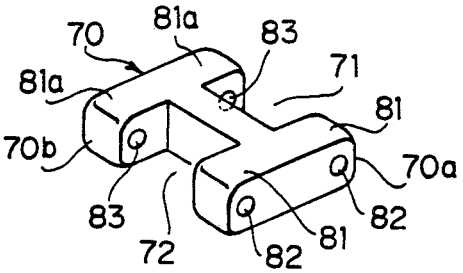
FIG. 37 is a perspective view showing a link of the fifth embodiment.

As shown in FIG. 31, the ornamental plate 58 has the same construction as the ornamental plate 25 of the second embodiment. Namely, the ornamental plate 58 has the vertical portion 36, the upper horizontal portion 37 having an engaging edge 61 and the lower horizontal portion 38 having an engaging edge 62.

The method for attaching the ornamental plate 58 to the connecting member 57 and the method for connecting the link 55 to the adjacent link 55 are the same as the second embodiment.

FIGS. 34 to 43 show the fifth embodiment.

A link 70 made of brass has a pair of recesses 71 and 72 on both sides 70*a* and 70*b* thereof defining two pairs of connecting legs 81, 81*a* on both of the sides 70*a* and 70*b*. Thus, the link has an H-shape. A pair of perforated holes 82 are formed in the connecting legs 81 and a pair of perforated engaging holes 83 are formed in the connecting legs 81*a*.

Figure 38:
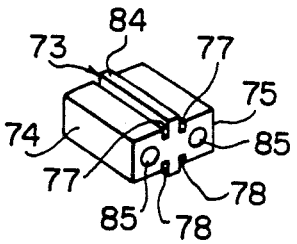
FIG. 38 is a perspective view showing a connecting link of the fifth embodiment.
Figure 39:
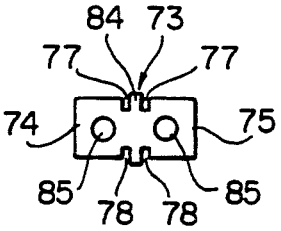
FIG. 39 is a side view of the connecting link.

In this embodiment, a connecting link 73 made of brass is provided for connecting the links 70. As shown in FIGS. 38 and 39, the connecting link 73 comprises ribs 84 on the upper and reverse sides and a pair of connecting members 74 and 75 symmetrically provided on opposite sides of the ribs 84. The height of the rib 84 corresponds to the thickness of the link 70. The connecting members 74 and 75 are provided to be engaged with the recesses 71 and 72 of the link 1. Each connecting member has a perforated hole 85 for the connecting pin 9, and upper and lower engaging notches 77 and 78 formed along the ribs 84.

Figure 40:
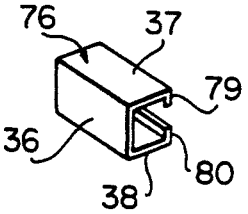
FIG. 40 is a perspective view showing a decorating plate of the fifth embodiment.

As shown in FIG. 40, an ornamental plate 76 has the same construction as the ornamental plate 25 of the second embodiment. The ornamental plates 76 are mounted on the respective connecting members 74 and 75 of the connecting link 73 through upper and lower engaging edges 79 and 80 engaged with the engaging notches 77 and 78. When the ornamental plates 76 are mounted on the connecting members 74 and 75, the upper and lower surfaces of the ornamental plates 76 are flush with the ribs 84.

Figure 41:
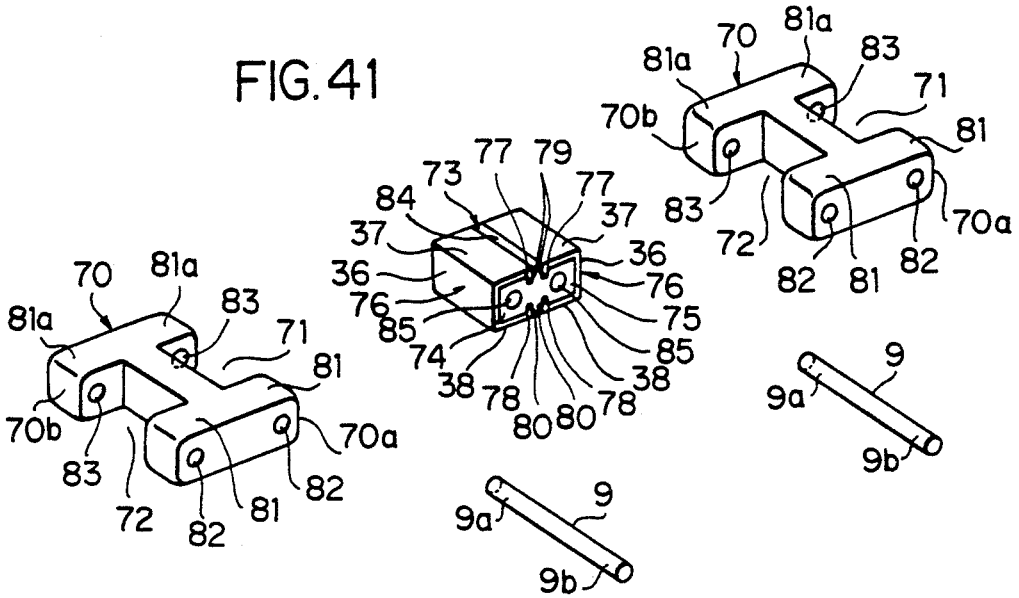
FIG. 41 is an exploded perspective view for explaining an assembling of links and connecting link of the fifth embodiment.
Figure 42:
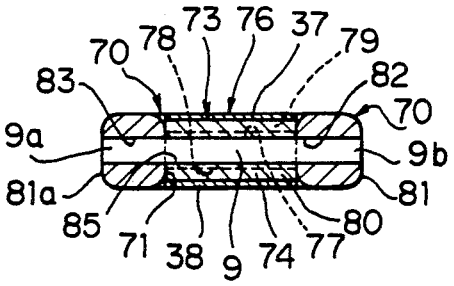
FIG. 42 is a sectional view showing a main part of the fifth embodiment.
Figure 43:
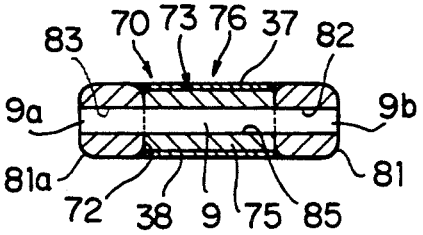
FIG. 43 is a sectional view showing another main part of the fifth embodiment.
Figure 44:
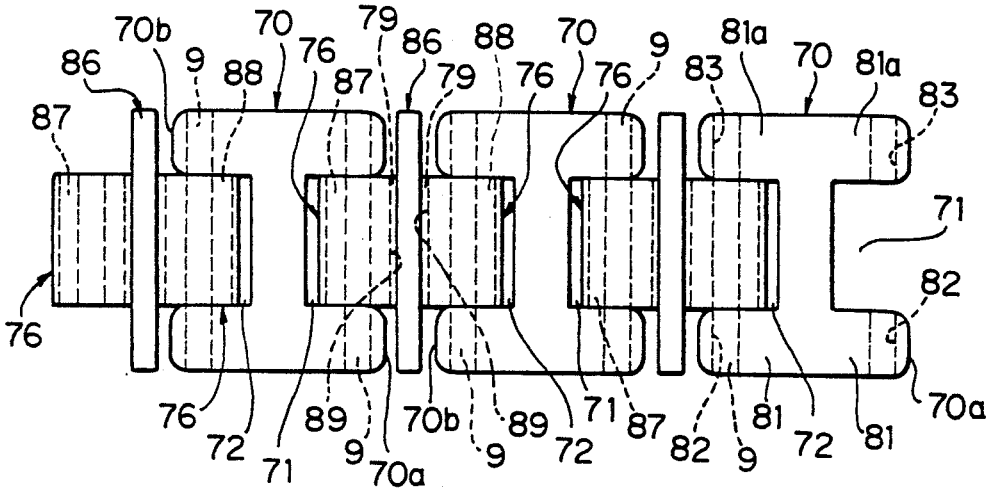
FIG. 44 is a plan view showing a sixth embodiment of the present invention.
Figure 45:
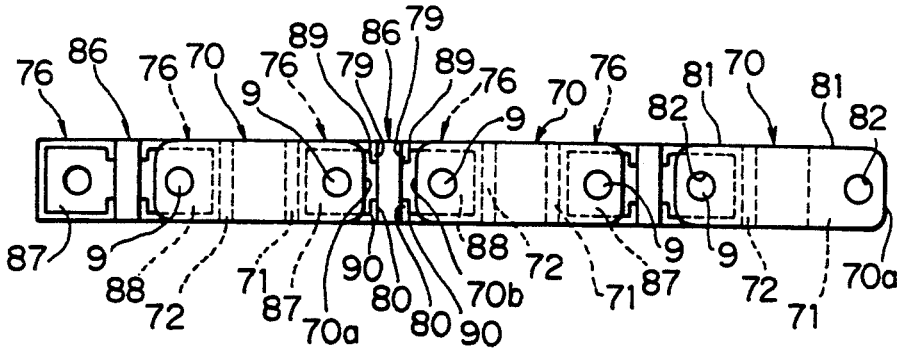
FIG. 45 is a side view of the sixth embodiment.
Figure 46:
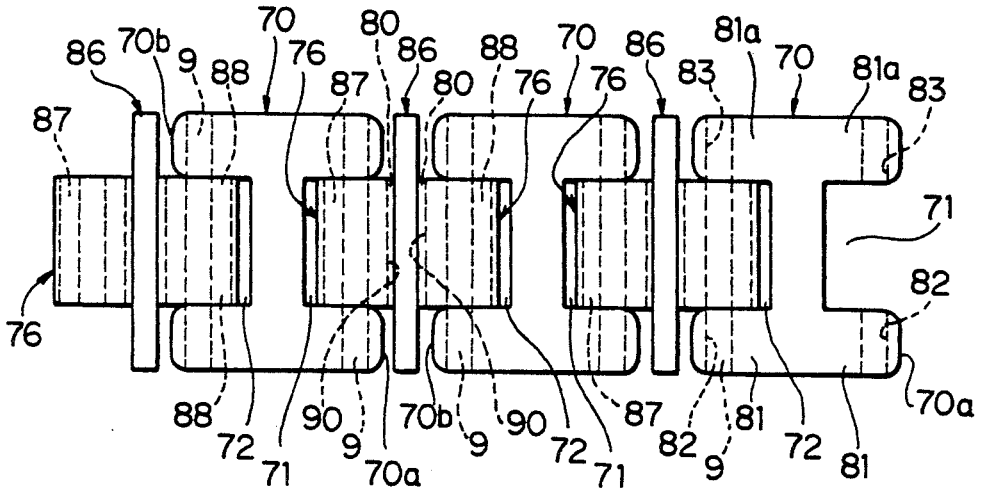
FIG. 46 is a plan view showing the reverse side of the sixth embodiment.

An operation for connecting the link 70 to the adjacent link 70 will be described with reference to FIGS. 41 to 43.

After engaging the ornamental plates 76 with the connecting members 74 and 75 of the connecting link 73, the recess 71 of the link 70 is engaged with the connecting member 74 of the connecting link 73. The perforated hole 85 of the connecting member 74 is positioned to coincide with the perforated holes 82 and 83 of the connecting legs 81 and 81*a* on the side 70*a* of the link 70. The connecting pin 9 is inserted in the perforated holes 82, 85 and 83. The end 9*a* of the pin 9 is engaged with the hole 83 with force fit so that the pin 9 is secured to the connecting leg 81*a* and the end 9*b* of the pin 9 engages with the hole 82. Then, the connecting member 75 of the connecting link 73 is engaged with the recess 72 of the adjacent link 70. The perforated hole 85 of the connecting member 75 is positioned to correspond to the perforated holes 82 and 83 of the connecting legs 81 and 81*a* on the side 70*b* of the adjacent link 70. The connecting pin 9 is inserted in the perforated holes 82, 85 and 83 as described above. Thus, the link 70 is connected to the adjacent link 70 through the connecting link 73 by the connecting pins 9.

Referring to FIGS. 44 to 51 showing the sixth embodiment. the links 70 which are the same as in the fifth embodiment. are connected to each other through connecting links 86.

Figure 47:
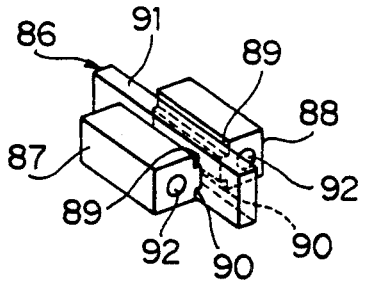
FIG. 47 is a perspective view showing a connecting link of the sixth embodiment.
Figure 48:
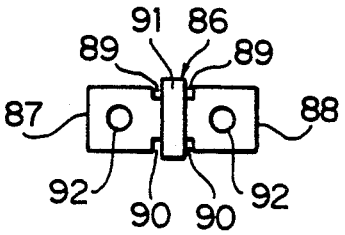
FIG. 48 is a side view of the connecting link.
Figure 49:
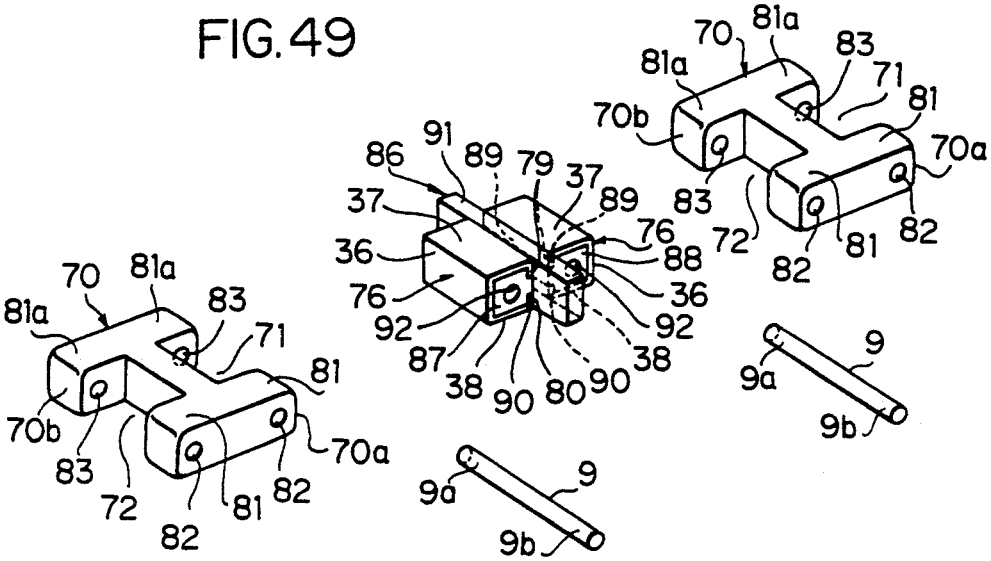
FIG. 49 is an exploded perspective view for explaining an assembling of links and connecting link of the sixth embodiment.
Figure 50:
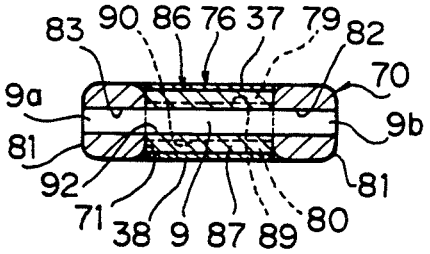
FIG. 50 is a sectional view showing a main part of the sixth embodiment.
Figure 51:
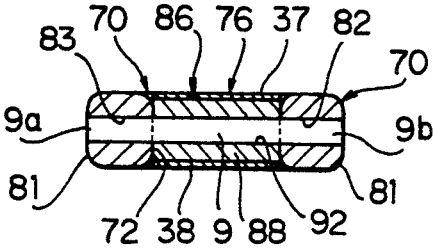
FIG. 51 is a sectional view showing another main part thereof.
Figure 52:
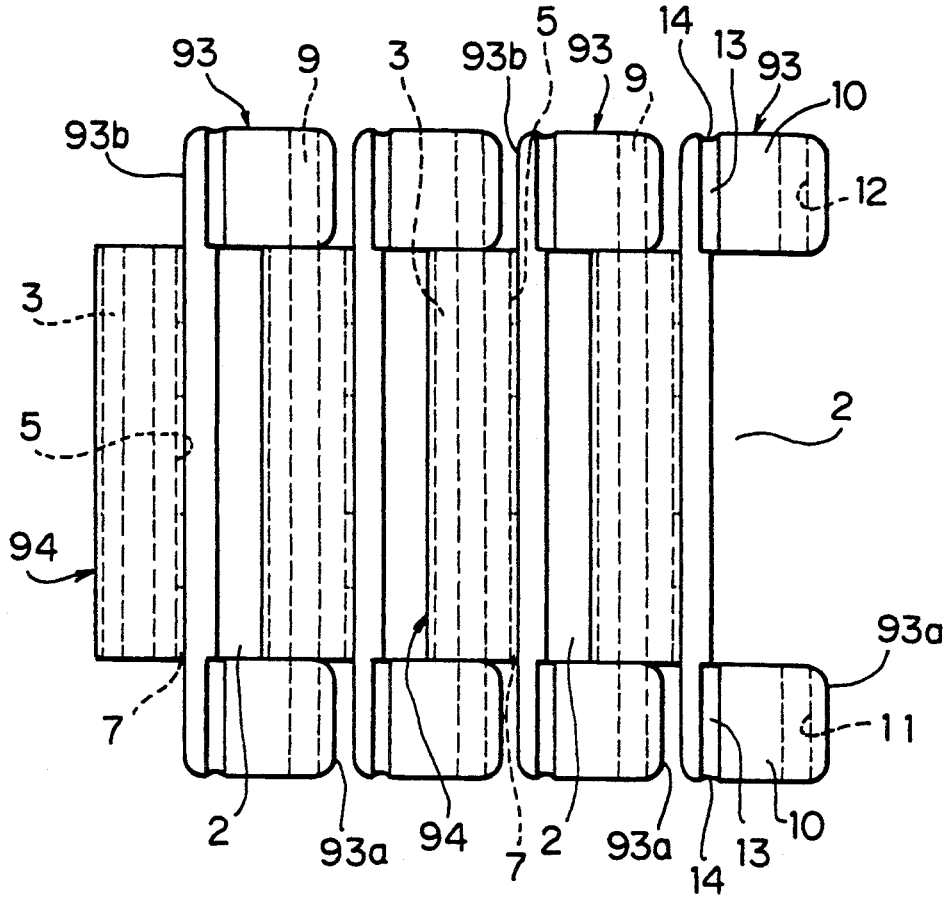
FIG. 52 is a plan view showing a seventh embodiment of the present invention.
Figure 53:
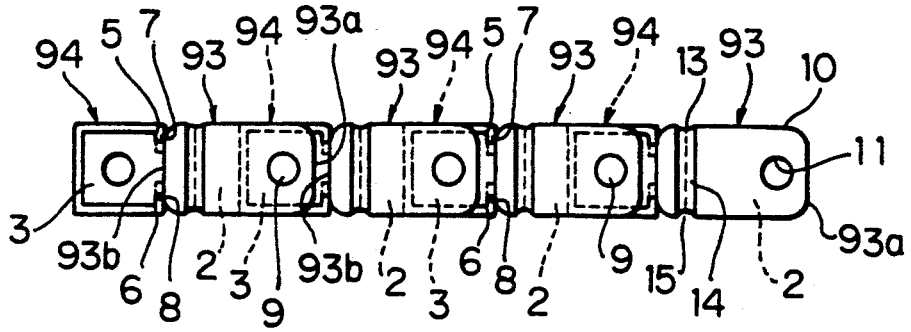
FIG. 53 is a side view of the seventh embodiment.
Figure 54:
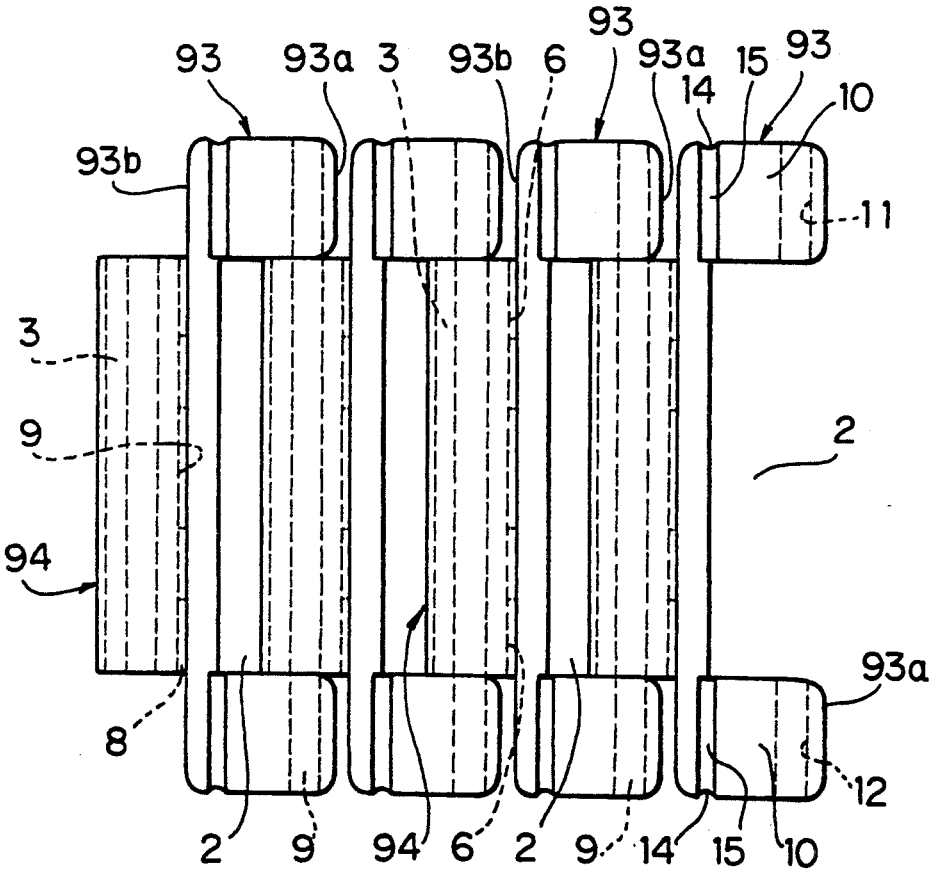
FIG. 54 is a plan view showing the reverse side of the seventh embodiment.

As shown in FIGS. 47 and 48. the connecting link 86 comprises a plate member 91 and a pair of connecting members 87 and 88 symmetrically provided on opposite sides of the plate member 91. The height of the plate member 91 corresponds to the thickness of the link 70. Further, end portions of the plate member 91 are projected from the connecting members so that the length of the plate member 91 corresponds to the width of the band. Each of the connecting members 87 and 88 has a perforated hole 92 for the connecting pin 9, and upper and lower engaging notches 89 and 90. The ornamental plate 40 is mounted on each of the connecting members 87 and 88.

The operation for connecting the links 70 through the connecting link 86 is the same as in the fifth embodiment. Thus, the description thereof is omitted.

Referring to FIGS. 52 to 60 showing the seventh embodiment, a link 93 of the seventh embodiment is the same as the link 1 of the first embodiment in construction. except for the lateral groove 17 provided on the connecting member 3 and the lateral projection 21 on the ornamental plate 4.

Figure 55:
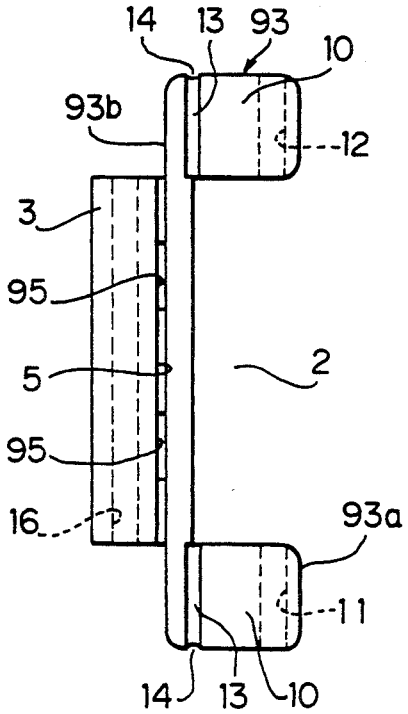
FIG. 55 is a plan view showing a link of the seventh embodiment.
Figure 56:
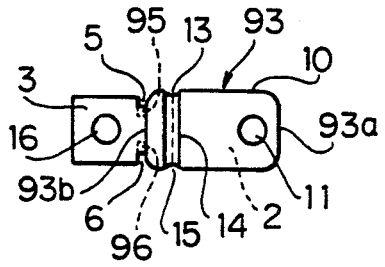
FIG. 56 is a side view of the link.
Figure 57:
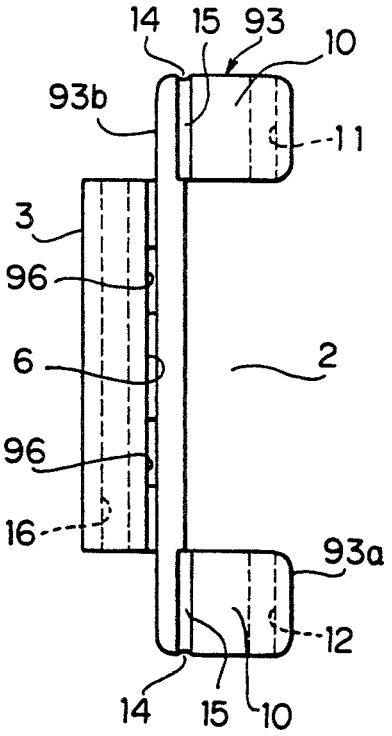
FIG. 57 is a reverse side view of the link.

As shown in FIGS. 55 to 57. the connecting member 3 has a plurality of recesses 95 formed in the bottom of the engaging notch 5 and a plurality of recesses 96 formed in the bottom of the engaging notch 6.

Figure 58:
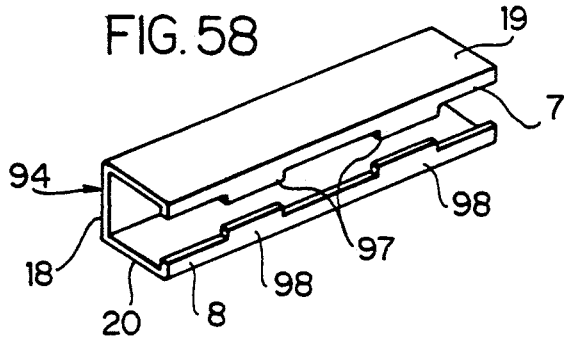
FIG. 58 is a perspective view showing a decorating plate of the second embodiment.
Figure 59:
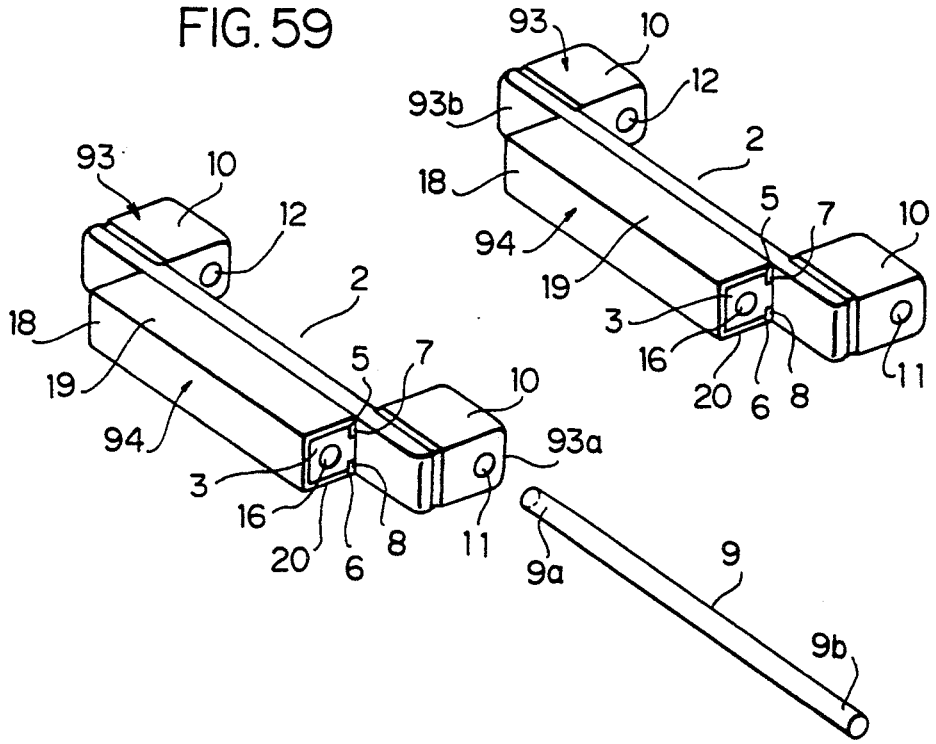
FIG. 59 is an exploded perspective view for explaining an assembling of links of the seventh embodiment.
Figure 60:
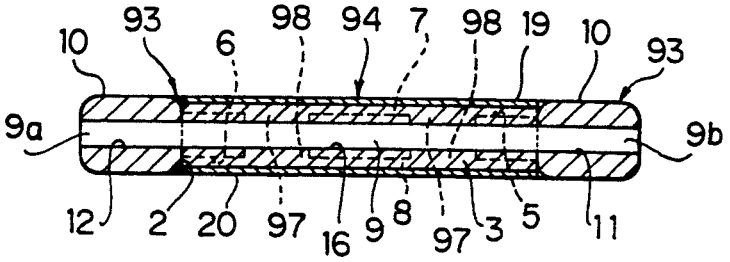
FIG. 60 is a sectional view showing a main part of the seventh embodiment.
Figure 61:
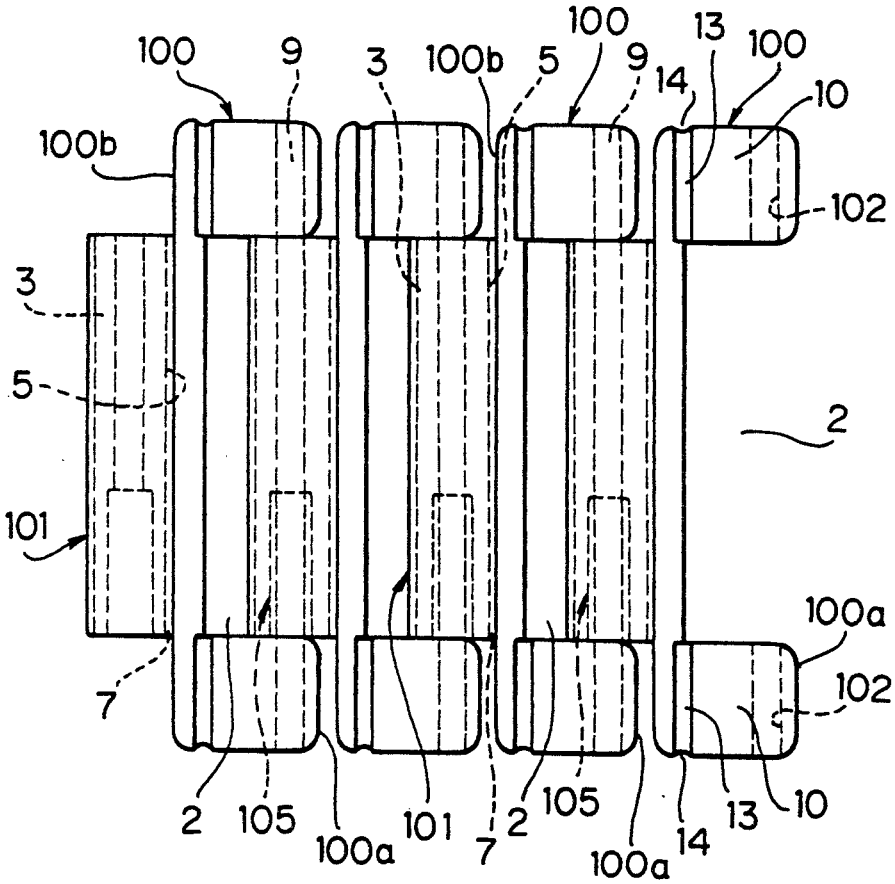
FIG. 61 is a plan view showing an eighth embodiment of the present invention.
Figure 62:
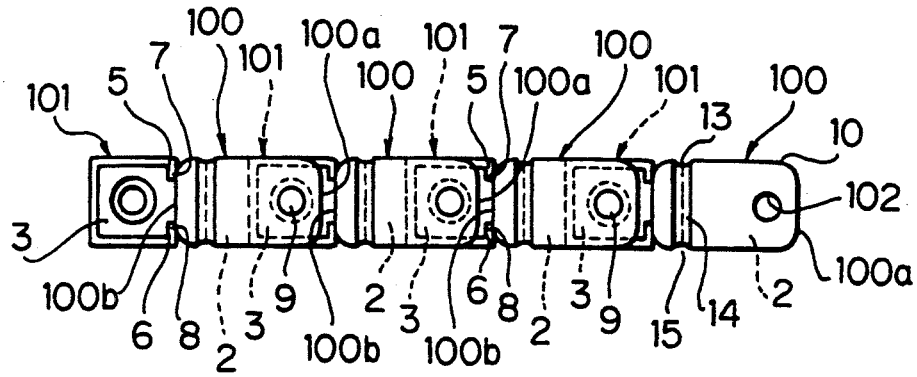
FIG. 62 is a side view of the eighth embodiment.
Figure 63:
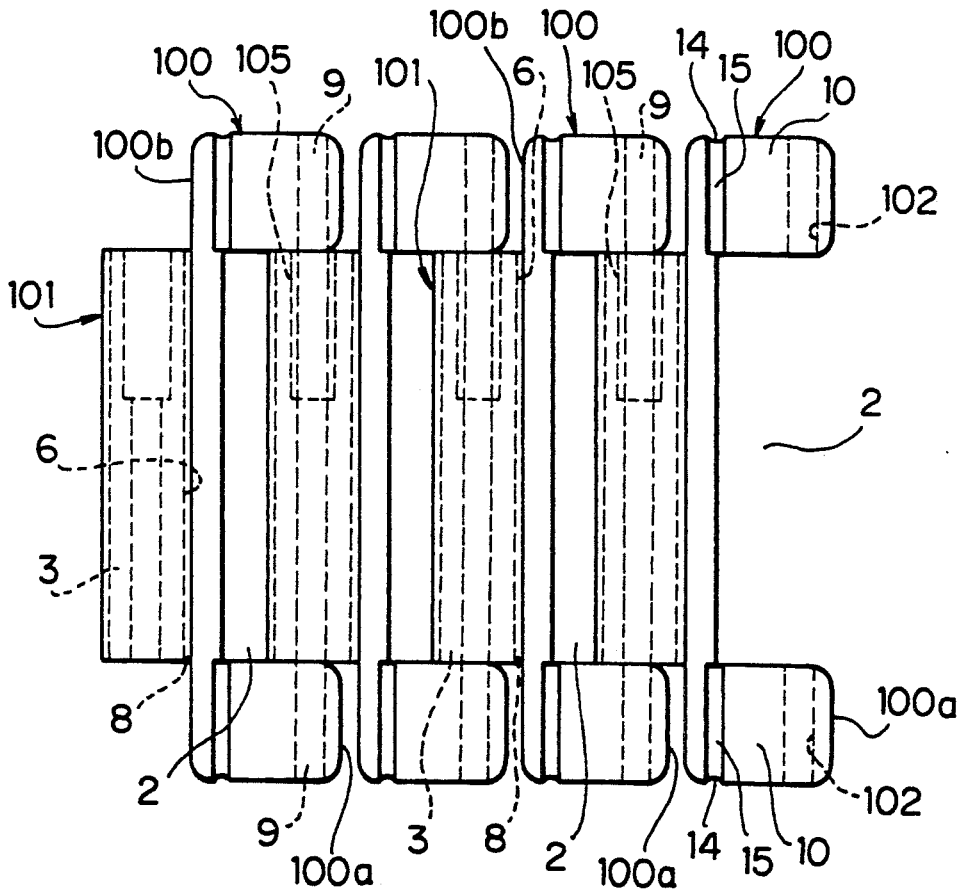
FIG. 63 is a plan view showing the reverse side of the eighth embodiment.
Figure 64:
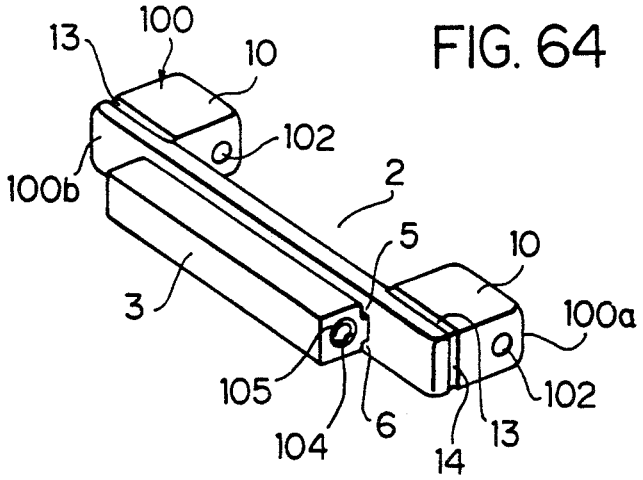
FIG. 64 is a perspective view showing a link of the eighth embodiment.

Referring to FIG. 58, an ornamental plate 94 has a plurality of projecting portions 97 downwardly provided on the engaging edge 7 and a plurality of projecting portions 98 upwardly provided on the engaging edge 8.

When the ornamental plate 94 is mounted on the connecting member 3, the engaging edges 7 and 8 slide on the engaging notch 5 and 6, and the projecting portions 97 and 98 engage with the recesses 95 and 96, respectively. Thus, the lateral displacement of the ornamental plate 94 on the connecting member 3 is prevented.

Other parts of the link 93 are the same as the link 1 of the first embodiment and the same parts thereof are identified with the same reference numerals; and the method for connecting the links 93 is the same as the first embodiment.

FIGS. 61 to 70 show the eighth embodiment.

A link 100 of the eighth embodiment is the same as the link 1 of the first embodiment in construction, except for the lateral groove 17 provided on the connecting member 3, and the lateral projection 21 on the ornamental plate 4 is not formed on the lower portion 20 of an ornamental plate 101.

In this embodiment, each of the connecting legs 10, 10 has a perforated hole 102.

Figure 65:
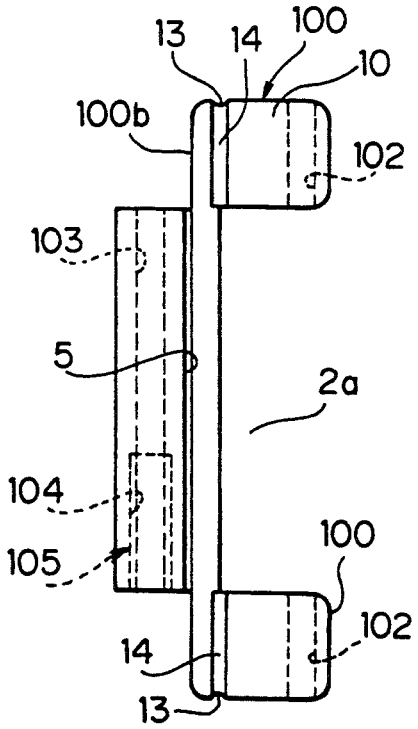
FIG. 65 is a plan view of the link.
Figure 66:
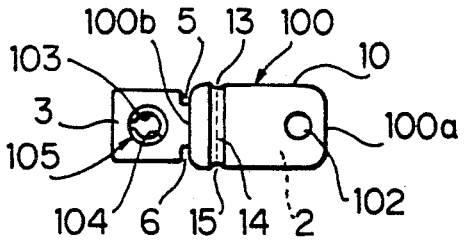
FIG. 66 is a side view of the link.
Figure 67:
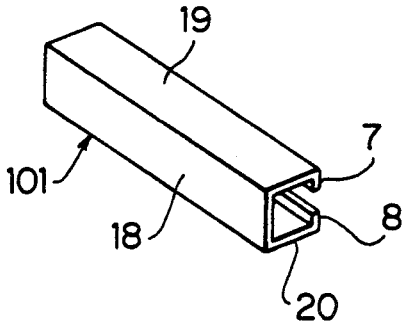
FIG. 67 is a perspective view showing a decorating plate of the eighth embodiment.
Figure 68:
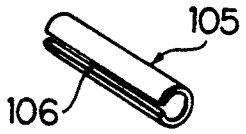
FIG. 68 is a perspective view of an engaging pipe.
Figure 69:
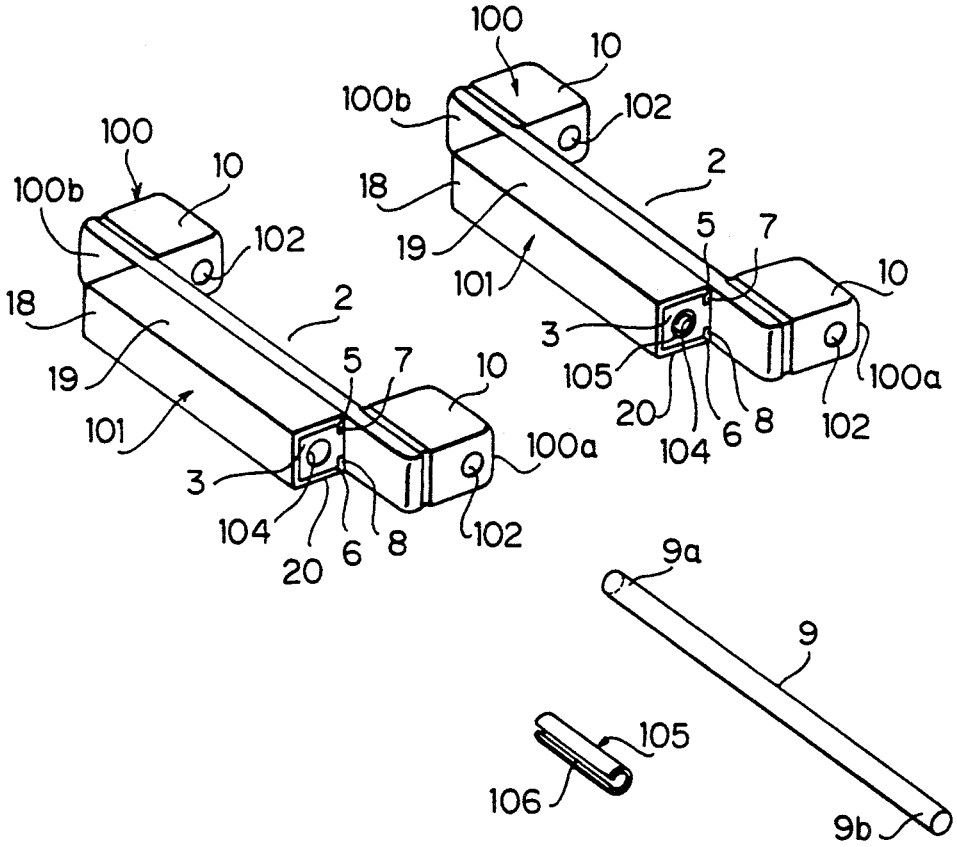
FIG. 69 is an exploded perspective view for explaining an assembling of links of the eighth embodiment.
Figure 70:
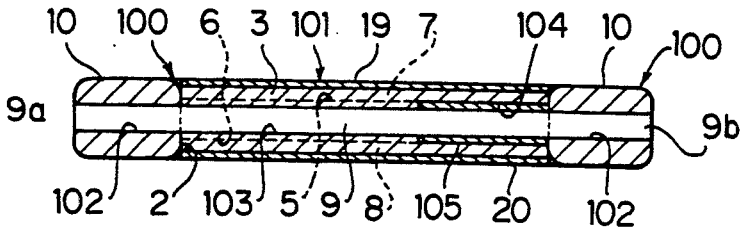
FIG. 70 is a sectional view showing a main part of the eighth embodiment.

As shown in FIGS. 65 and 66, the connecting member 3 has a perforated hole 103 having an engaging hole 104 having a larger inner diameter than the hole 103, and an engaging pipe 105 engaged with the engaging hole 104. As shown in FIG. 68. the engaging pipe 105 has a slit 106 formed in the axial direction thereof.

The engaging pin 9 inserted into the hole 103 is prevented from axially moving by the engaging pipe 105.

Other parts of the link 100 and the method for connecting the links 100 are the same as the first embodiment.

In the present invention, the link, may be made of stainless steel, titanium and synthetic resin. The ornamental plate is made from a material which has a different color tone from the link and pure gold.

In accordance with the present invention, an ornamental plate of a different material from the link can be mounted on the connecting member of the link, thereby changing the color tone of the link and enhancing the decorative effect of the band.

The ornamental plate is easily and firmly attached to the connecting member of the link to reinforce the connecting member. Since the ornamental plate is small in size, manufacturing cost is low.

While the invention has been described in conjunction with preferred specific embodiments thereof, it will be understood that this description is intended to illustrate and not limit the scope of the invention, which is defined by the following claims.

What is claimed is:

1. A watch band comprising:

a plurality of link units;

a plurality of connecting pins; and a plurality of ornamental plates;

each of said link units comprising a link and a connecting member, said link having at least one pair of legs projecting in a longitudinal direction of said watch band, each pair of legs defining a recess extending therebetween perpendicular to said longitudinal direction of the watch band;

said connecting member engaging with said recess, and said connecting pin connecting said connecting member to said legs;

said connecting member having an upper engaging notch and a lower engaging notch extending perpendicular to said longitudinal direction of the watch band;

each of said ornamental plates having engaging edges formed therein, said engaging edges engaging said upper and lower engaging notches in the connecting member so as to mount said ornamental plate on said connecting member.

2. The watch band of claim 1, wherein said connecting member comprising a projection projecting from one side of said link, and said at least one pair of legs comprises one pair of legs projecting from an opposite side of said link.

3. The watch band of claim 1, wherein said connecting member comprises a separate connecting link, and said at least one pair of legs comprises two pairs of legs projecting from two opposite sides of said link.

* * * * *